US011542748B2

(12) United States Patent
Daugherty et al.

(10) Patent No.: US 11,542,748 B2
(45) Date of Patent: Jan. 3, 2023

(54) DEVICE FOR FLUSHING DECKS IN AN ENCLOSED AREA

(71) Applicants: John K Daugherty, Coral Springs, FL (US); Jake Evans, Charlotte, NC (US)

(72) Inventors: John K Daugherty, Coral Springs, FL (US); Jake Evans, Charlotte, NC (US)

( * ) Notice: Subject to any disclaimer, the term of this patent is extended or adjusted under 35 U.S.C. 154(b) by 0 days.

(21) Appl. No.: 16/974,244

(22) Filed: Nov. 30, 2020

(65) Prior Publication Data

US 2022/0170317 A1 Jun. 2, 2022

(51) Int. Cl.

| | |
|---|---|
| ***E06B 7/32*** | (2006.01) |
| *E04B 1/00* | (2006.01) |
| *E06B 3/00* | (2006.01) |

(52) U.S. Cl.

CPC ..... *E06B 7/32* (2013.01); *E04B 1/0046* (2013.01); *E06B 3/00* (2013.01)

(58) Field of Classification Search

CPC ..... E04F 17/00; E04F 15/02183; E04B 1/70; E04B 1/003; E04B 1/7076; E04B 1/0046; E06B 7/32; E04D 13/0477

See application file for complete search history.

(56) References Cited

U.S. PATENT DOCUMENTS 3,220,079 A * 11/1965 Aggson ..... E04B 1/7076 454/271
4,026,082 A * 5/1977 Crofoot ..... F24F 7/00 52/656.2
5,496,213 A * 3/1996 Miller ..... E04G 15/02 52/302.1
6,012,260 A * 1/2000 Hendrick ..... F24F 13/082 52/302.1
6,129,838 A * 10/2000 Millner ..... E04D 13/0459 52/302.1
6,165,066 A * 12/2000 Sharp ..... F24F 13/082 52/302.1
6,973,757 B2 * 12/2005 Marks ..... E04F 17/00 52/302.1
7,128,643 B2 * 10/2006 Beliveau ..... F24F 13/085 454/271
7,937,899 B2 * 5/2011 Earls ..... E02D 31/02 52/302.7
8,336,268 B2 * 12/2012 Delaquis ..... E03C 1/122 52/302.1
8,522,499 B2 * 9/2013 Manson ..... E04B 1/003 52/16
9,085,892 B1 * 7/2015 Wilson ..... E02D 31/06
2004/0163342 A1 * 8/2004 Marks ..... E04F 17/00 52/302.1
2007/0254585 A1 * 11/2007 Achen ..... F24F 13/084 454/271
2009/0151274 A1 * 6/2009 Earls ..... E02D 31/02 52/169.5
2009/0223147 A1 * 9/2009 Spignesi ..... E04F 17/00 52/302.3

* cited by examiner

*Primary Examiner* — Justin B Rephann

(57) ABSTRACT

This device is presented as a bulkhead doorway attached to a wall structure, such as a sunroom or an enclosed pool; this device connects the interior space to the outside; and with this device a user can completely clean, rinse and clear the floor surface of the enclosure.

6 Claims, 6 Drawing Sheets

200

DEVICE FOR FLUSHING DECKS IN AN ENCLOSED AREA

TECHNICAL FIELD OF THE INVENTION

Similar to Mechanical Building Structures.

BACKGROUND OF THE INVENTION

When flushing a floor surface that is only enclosed by a screen-walled structure, one must manage a water stream and debris. The debris is sometimes swept, but often captured by water using a hose or pressure washer. Currently, users must direct accumulated debris and a growing puddle of water toward the one opening in the walled structure—the door that people use for access and egress to the space.

Again, one door is usually available in a given screened enclosure. This is usually 35 to 70 feet from the furthest floor space in the enclosure.

Consider also that debris in a screened enclosure has settled on the screen and is washed down by rain, thus it has a very fine particle size. The debris can also include pet hair, plant leaves, potting soil, and trash left by people which is larger and difficult to move. While clearing the deck (such as pressure washing) one must manage the complex debris pile for example, for 35-70 feet. This is extremely time-consuming for the user.

Currently, some add-on doorways are commonly designed for pets. The doorway in many patent disclosures is on the screen door itself. The present invention is specifically designed for installation with a low profile, at the floor level, and specifically designed to accommodate deck flushing activity. The present invention channels and allows water to exit at a high velocity without being tied to a door location.

Other key distinctions include operation of pet doors by animals. Animals provide a relatively sizeable and strong operating element. Further, a pet door must work for exit and entrance. These systems do not contemplate the unique needs of a deck flushing procedure. For example, water must be carefully directed. This direction applies to getting water to the doorway, through the doorway and out of the doorway. In addition, one must consider the base rail when routing water and debris.

What is needed is a way to improve the cleaning of an enclosed floor, that is self-closing and operates in one direction, that can be attached as a structural part of the walls of a walled structure.

BRIEF SUMMARY OF THE INVENTION

The targeted user of this invention is engaged in cleaning an outdoor floor surface that is enclosed by a screened or walled structure. The user will install the device at a location of their choosing and will use it to route, capture, and expel water and debris from inside to outside the screen.

The utility of this invention includes improved cleanliness and better hygiene in the area, and the convenience of reduced time required for the user to flush the deck.

Though the device described herein presents an embodiment that works with screened enclosures, the device can be adapted to work with any wall structure using adaptations familiar to those skillful in the art of construction.

The specification presents many exemplary and nonlimiting embodiments to improve functionality of the device. Each embodiment can be added or modified to create an optimal device for different applications, and it is understood that variations are possible and obvious to anyone with skill in the relevant art.

In certain embodiments further described herein, an effort is made to minimize the "damage" inflicted on the existing screen and wall of the enclosure. For example, an opening in the screen is demonstrated as having an exemplary, generally rectangular-shape. In the drawings, this open section is visible inside the frames and is cut from the enclosure by the user to leave a clear opening. This opening is framed in and secured with the device to provide a bulkhead passage for water and debris to exit the enclosed screen system. The device doorways cover the openings.

By first clamping and then removing this rectangular section of the screen or wall, the cut screen edges are constrained from fraying. In an embodiment, there is a groove and mating ridge formed into the inner and outer plates. This groove and ridge fit together to assist with alignment to improve the retention of the screen. In an embodiment, the inner and outer flange snap together using details that align, seal and secure the two parts together. In an embodiment, the inner and outer flanges are secured using mechanical fasteners, including but not limited to metal bolts and nuts. In an embodiment, the act of securing the inner and outer frames uses an integrated cutting edge to "cut out" the screen and creates an opening.

In an embodiment, the device essentially consists of an inner plate, an outer plate, and a door. The components are made of different materials including polymeric materials, aluminum, steel, other metals, other structural materials or any combination thereof. The inner plate and outer frames mate and are seated to one another along a vertical plane, clamping a portion of the screen or wall structure between them. The mating frames have a generally rectangular interior that encloses a visible section of the screen.

In an embodiment, there are two metal rims. One rim is along the rectangular interior opening of the inner frame, and another rim is similarly along the outer frame. The two rims align and mate together as the inner and outer frame are seated to one another. The metal rims are sized and sharpened such that fully mating the parts will simultaneously cut the screen to the size of the opening.

In an embodiment, a door is used on the device and is hinge mounted to any of the frame components, allowing gravity to close the door. The closure of the door to the frame is important to prevent debris, insects and larger pests from entering the doorway. The door may be weighted, use spring hinges, staked motion limiting protrusions, polymeric seals or fuzzy seals may be used to improve closure. In an embodiment, user controlled locking pins or rods are inserted and removed from the doorway to provide secure closure. In an embodiment, user controlled pivoting pins or rods are used with an elliptical shaped cam to variably secure the closure.

In an embodiment, the base rail of the screened enclosure is cut to precisely fit the device. Structural integrity is maintained by using stronger materials such as but not limited to aluminum for the inner and outer frames on the device. Flanges are included to anchor the device to the remaining sections of the baserail, and to the floor structure if needed. Closeout plates are contemplated to secure the openings at either side in the cut baserails. Interior flanges around the generally rectangular opening are used to channel water through the opening. Such flanges can be different lengths, for nonlimiting example from One inch to Four inches protruding into the interior space of the screened structure.

In an embodiment, cutting the baserail is avoided by using a ramped inlet surface to direct the water above the baserail—the debris pile generally flowing laterally, vertically, linearly and outwardly through a device door or rotating wheel assembly. In an embodiment, the ramp is made of polymeric materials. In an embodiment, the exposed edge of the ramp rests on the floor. The exposed edge is formed, uses a soft attached edge such as a rubber strip, or is presented in a way that avoids injury by users of the screened enclosure.

In an embodiment, the ramped inlet is formed as part of the inner plate. In an embodiment, the ramped inlet is secured to the inner plate using snaps or mechanical fasteners. In an embodiment the ramp has a roof and vertical walls on either side. This encloses the ramped inlet except for the entrance opening and exit opening. As an enclosed embodiment, water and debris are contained and directed in a very controlled manner. This allows a user to employ a high pressure water system to expel the debris to the outside in a spectacular manner, dispersing debris far away from the doorway and into the yard or other outside space.

In an embodiment, the door is a rotating wheel assembly. The wheel is mounted to the outer frame along a horizontal axis. The wheel rotates to allow water to pass below the pivot axis. Details on the frame or ramp prevent water passing above the pivot axis. The wheel has enclosed sides and details to limit rotation to specific stopping points are used to prevent access from the outside through the wheel assembly by debris or pests large and small. The rotating wheel can be inserted and removed from the interior for preventative maintenance or replacement. The wheel is secured at either axially using holes, snap in pockets, or secured attachments using mechanical fasteners or means. In an embodiment, spring loading, centering methods, and retaining mechanisms are contemplated.

In an embodiment, the enclosed ramped inlet has at least three internal vanes to prevent backflow of debris and water. The vanes are secured to the ceiling of the enclosure and are free to move on the remaining 3 sides. The vanes are sized and made of materials that allow them to move when water and debris pass, and are limited to one way motion by mechanical stops such as a molded lip or button at the bottom, and part of the ramped inlet assembly. The final vane can serve as the doorway if the hinged or other doorway fails. That is, the final vane can be sized and formed to make a robust seal to separate the outside elements from the inside elements with respect to the screen-walled structure. In an embodiment, the base of the enclosed ramped inlet is formed hollow to allow for cleaning and to resist accumulation of debris and allow preventative maintenance.

In an embodiment, the enclosed ramp is detachable from the rest of the device assembly and is used as a pressure washer dust pan. This pan embodiment has a handle rod attached to the roof of the enclosed ramp assembly. In an embodiment, this handle is removable. For this use, the dustpan can have a removable screen attachment at the outlet. This screen would allow water to pass through but would prevent larger debris from passing. In an embodiment, the pressure washer dust pan is weighted to resist the force of the pressure washer. In an embodiment, the pressure washer dust pan has bottom surface details such as texturing, adhered rubber or other high tactile materials to resist the force of the pressure washer.

DETAILED DESCRIPTION OF THE DRAWINGS

Figure 1:
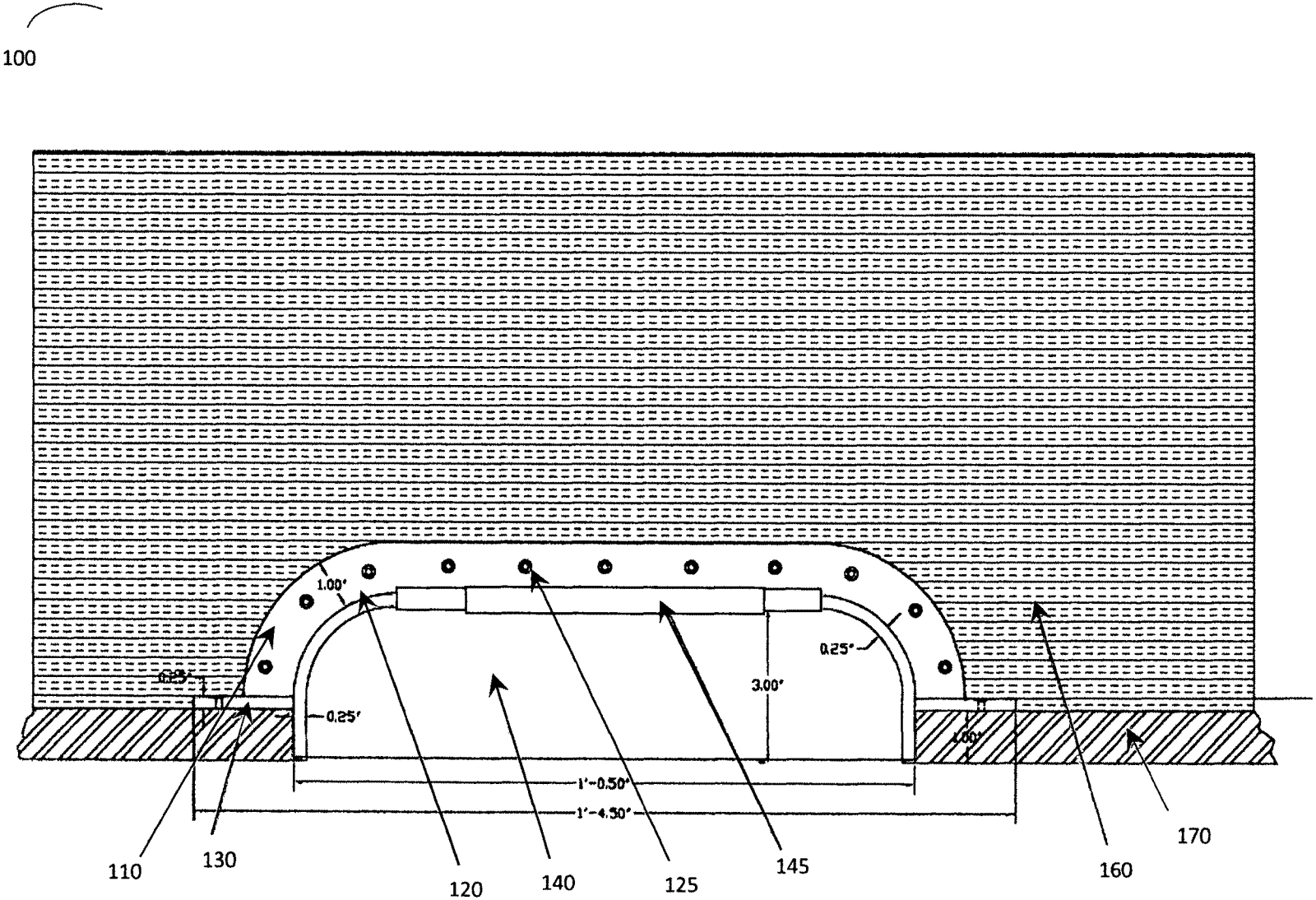
FIG. 1 is a nonlimiting example of a deck wash doorway.

FIG. 1 is a nonlimiting example of a deck wash doorway. A 110 angled interior bracket, a 120 exterior clamping plate (hidden behind interior bracket frame), two 130 "angle iron" frame clamps, and a 140 pivoting door. A representative location of the existing structural wall frame or screen is shown at 160, clamped between 110 and 120. The 110 bracket is installed by cutting and removing a section of the 170 structural wall frame, along its lower rail. Dimensions shown are typical, but understood to be variable based on the dimensions of the structural wall frame.

A snap fit, or interference fit means of securing is also contemplated in these embodiments.

The 110 interior bracket is attached to the 120 exterior clamping plate using at least two 125 fasteners, shown typical in eleven locations. The 110 interior bracket is secured to the two 130 angle iron frame clamps and the 170 lower rail using 245 fasteners in at least two locations. All components and fasteners are made of similar, compatible structural materials. Exemplary materials include aluminum, plastic, steel, stainless.

Figure 2:
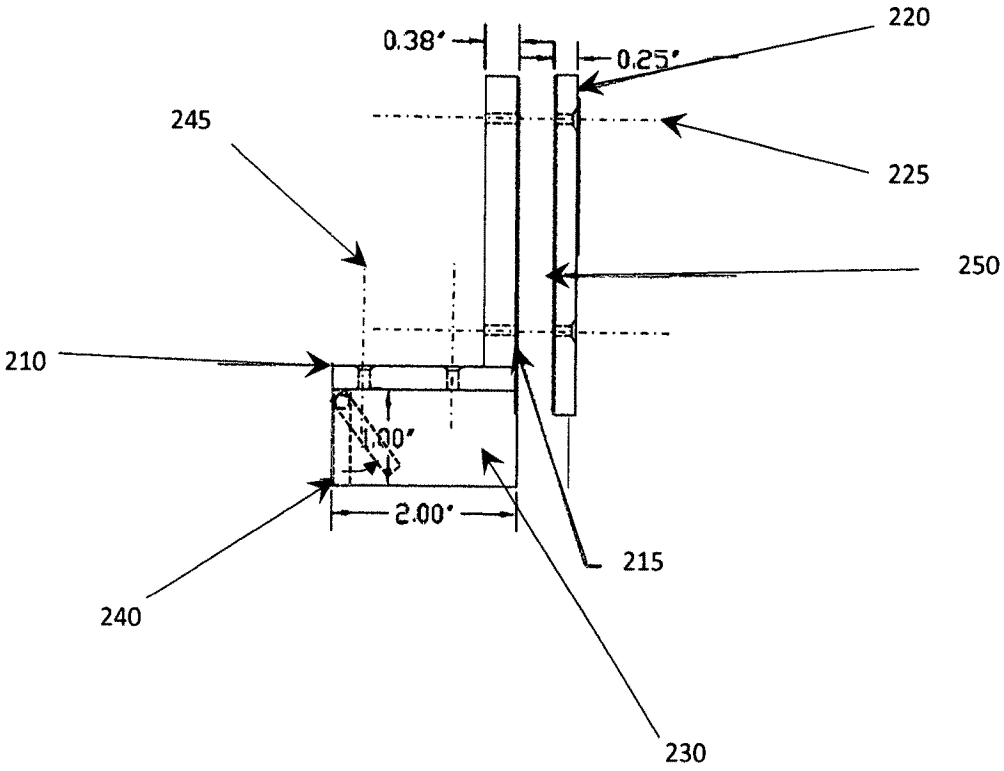
FIG. 2 is a nonlimiting example of a deck wash doorway.

FIG. 2 is a nonlimiting example of a deck wash doorway is comprised of four main components. A 210 angled interior bracket, a 220 exterior clamping plate, two 230 "angle iron" frame clamps, and a 240 pivoting door. A representative location of the existing structural wall frame or screen is shown at 250, clamped between 210 and 220. The 210 bracket is installed by cutting and removing a section of the structural wall frame, along its lower rail. Dimensions shown are typical, but understood to be variable based on the dimensions of the structural wall frame.

A snap fit, or interference fit means of securing is also contemplated in these embodiments The 210 interior bracket (having 215 integrated upper portion) is attached to the 220 exterior clamping plate using 225 fastener, typical in at least four locations. The 210 interior bracket is secured to the two 230 angle iron frame clamps using 245 fasteners in at least two locations. All components and fasteners are made of similar, compatible structural materials. Exemplary materials include aluminum, plastic, steel, stainless.

Figure 3:
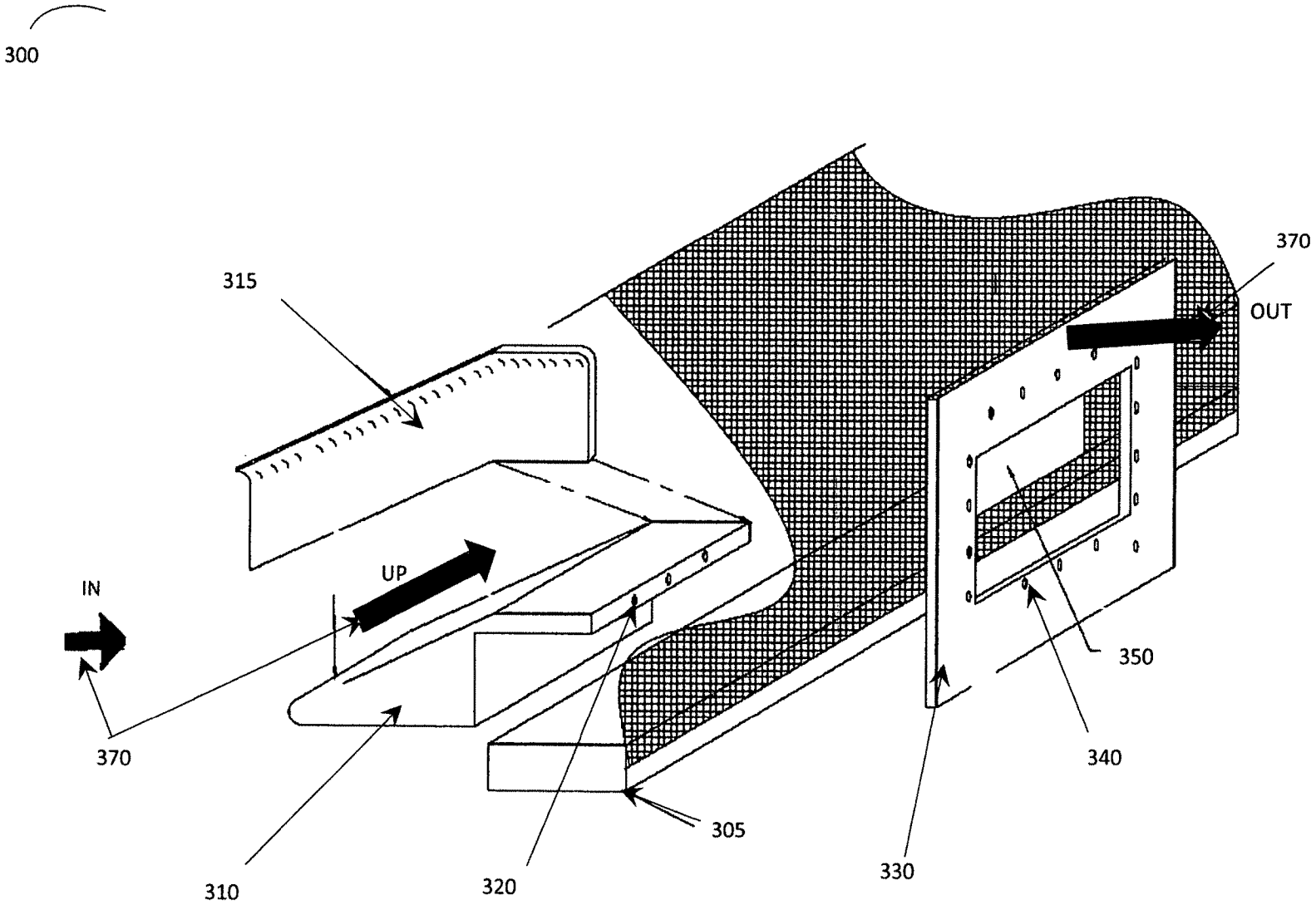
FIG. 3 is a nonlimiting example of a ramped deck wash doorway.

FIG. 3 is a nonlimiting example of a ramped deck wash doorway installed to an exterior wall of a screened enclosure. 310 demonstrates the doorway ramp structure. The housing is shown with a hollow path that is open to the outside and inside, having 370 air, water and debris flow directions from inside, up the ramp and to the outside (arrows shown in 3 places); the arrow labels indicate the direction of airflow. Two 315 side plates attach to the 310 ramp assembly in 2 places. Here, one 315 side plate is shown for clarity. The 315 side plates are attached at either side of the 310 ramp to contain a flow of debris and water within a horizontal space.

The 310 ramp sits on and adjacent to the 305 base rail of the wall of the enclosed structure. 310 and 305 are secured together using at least one vertical fastener, not shown. This attachment strategy is intended to avoid cutting the wall frame base rail.

The ramp is secured by 320 threaded holes and fasteners to the 330 exterior screen frame plate, An opening at 350 in the screen must be cut, and a self closing door is installed (not shown for clarity). A snap fit, or interference fit means of securing is also contemplated in these embodiments. The original loose edge of the screen is secured at the 305 baserail in a 370 channel using typical screen spline installation hardware. A similar channel is present in the 330 exterior screen plate around the 350 opening to secure the new screen edges.

The 370 channel is shown in FIG. 3 but is applicable to all embodiments as a means to secure a screen edge.

Figure 4:
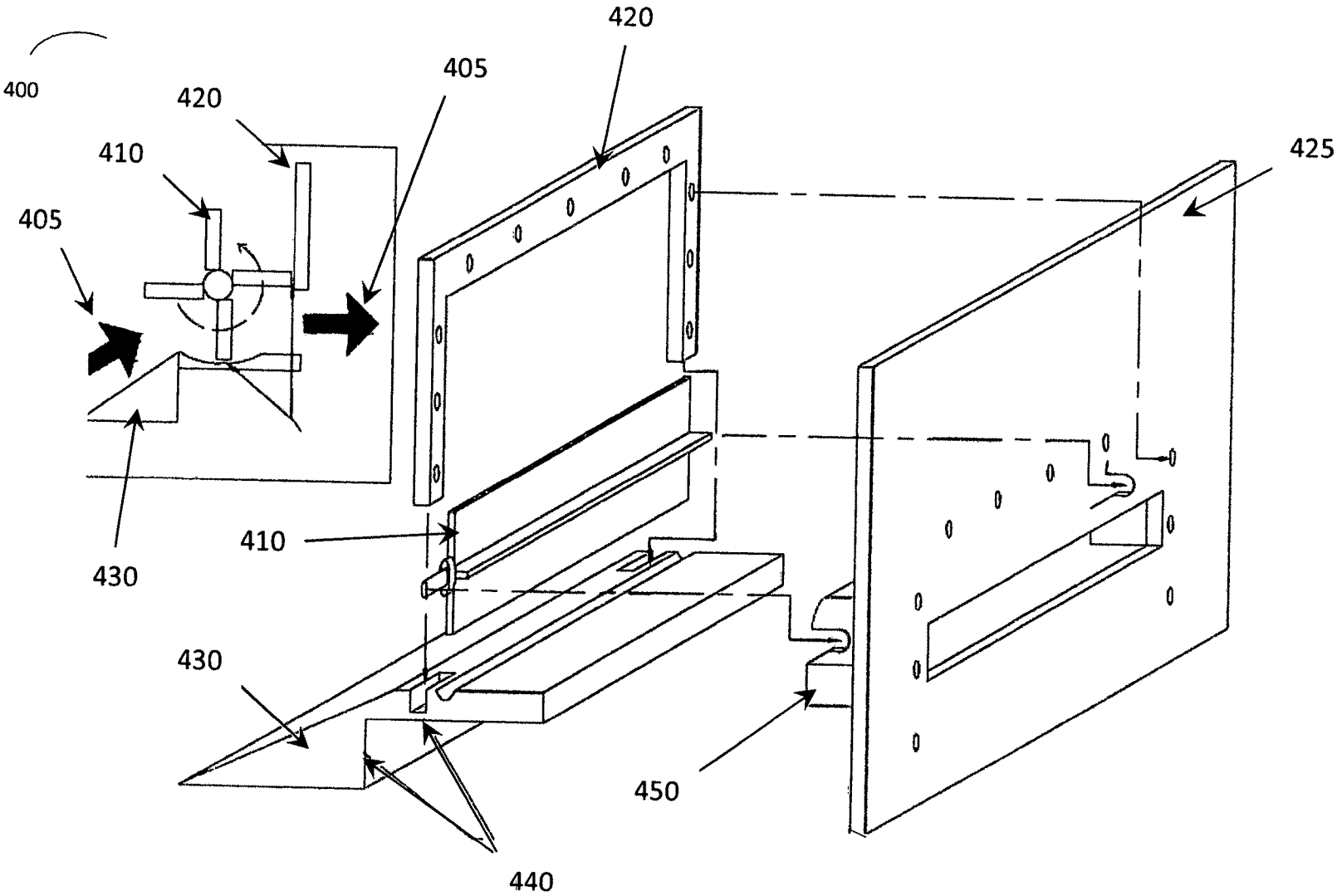
FIG. 4 is a nonlimiting example of a rotating blade deck wash doorway.

FIG. 4 is a nonlimiting example a rotating-blade deck-wash doorway assembly. The doorway assembly is installed to an enclosure wall similar to other embodiments. In 400 demonstration, the doorway assembly is installed over the base rail. In addition, the screen of the enclosure wall is cut to allow an opening that is framed by the doorway and blocked by the 410 rotating blade. 405 demonstrates two arrows showing the direction of the flow of water and debris from inside of an enclosed structure to the outside, through the deck wash doorway assembly.

The 410 rotating blade is made of durable materials that are lightweight such as plastic or aluminum. The 410 blade is secured to the 420 inner faceplate, the 425 exterior faceplate having the 450 retension detail, and a channel in the 430 base ramp. At 440, the 430 base ramp fits over a lower rail of the enclosure wall. 460 demonstrates fastening holes and an attachment means in a nonlimiting arrangement of bolts, nuts and/or snap fit attachments in at least (2) locations. 460 attachments secure the inner plate to the outer plate and capture the edges of an opening that is cut into the screen of an enclosed space.

Figure 5:
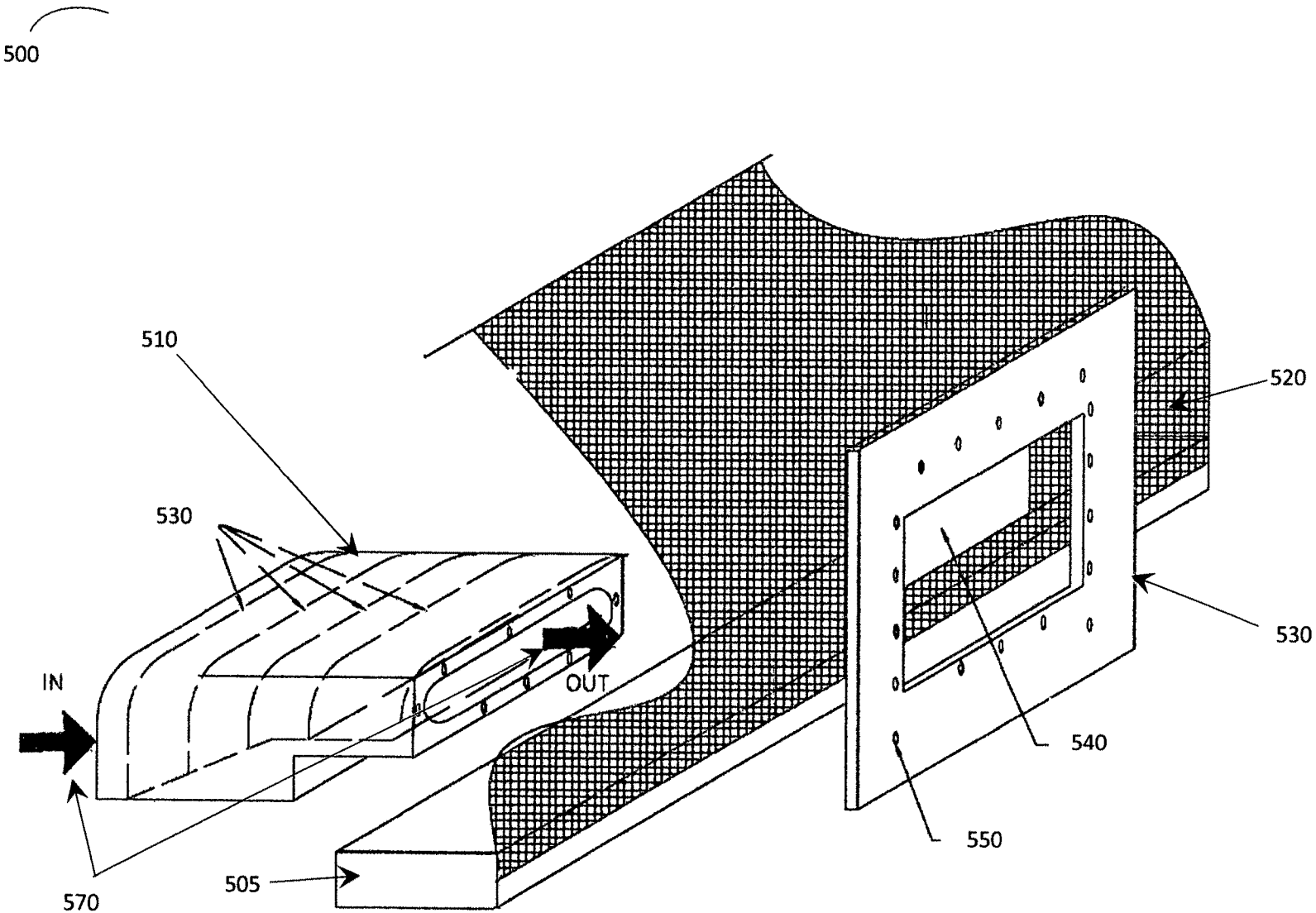
FIG. 5 is a nonlimiting example of a multiple vaned back flow preventing deck wash doorway.

FIG. 5 is a nonlimiting example of a multiple-vaned, backflow-preventing deck wash doorway. 510 demonstrates the deck wash doorway housing. The housing is shown with a hollow path that is open to the outside and inside, having 570 air flow directions from inside, up the ramp and outside; the arrow labels indicate airflow. Debris travels into the housing from the inside and out to a yard, sidewalk or other exterior environment. The 510 housing is secured to the 505 base rail of the enclosure wall. The 510 housing is attached to a 530 exterior mounting plate, clamping and securing the 520 enclosure screen, while requiring a small 540 rectangular cut in the 520 screen. The 530 frame secures the 510 ramp outlet opening to the 540 frame opening using fasteners at multiple locations such as 550. At 340 a one way door can be installed. A snap fit, or interference fit means of securing is also contemplated in these embodiments.

Inside the 510 housing are at least one 530 flexible vane structure. The vanes are attached along their top edges to the ceiling of the 510 housing. The lower edges of the vanes move freely, but are motion limited to restrict backflow of water, debris, bugs, etc. from the outside to the inside of the enclosed structure walls.

Figure 6:
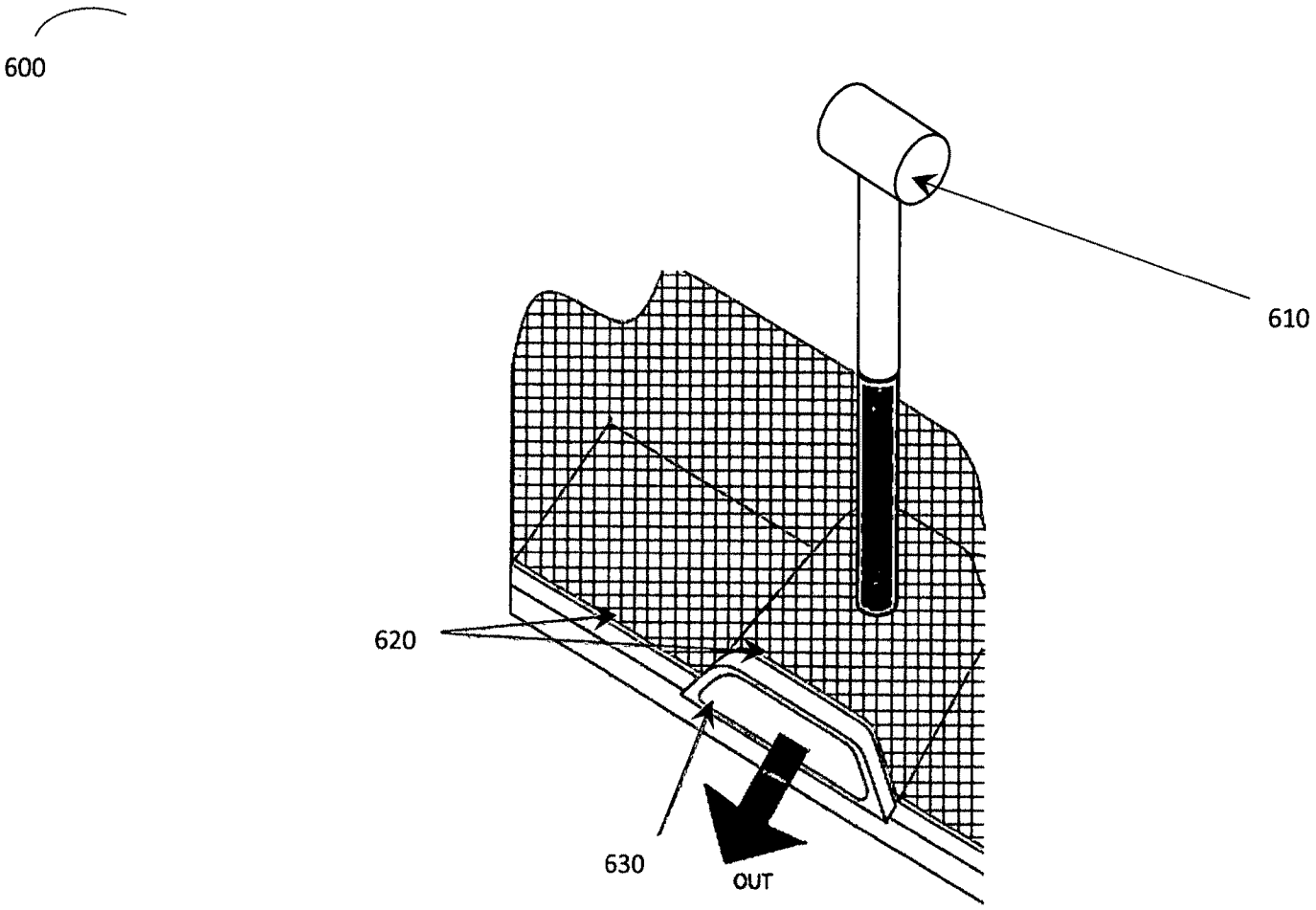
FIG. 6 is a nonlimiting example of a portable catch pan deck wash doorway.

FIG. 6 is a nonlimiting example of a portable catch pan deck wash doorway. This portable assembly is used with at least one "docking station". 610 demonstrates a handle and shaft that are attached to a doorway housing or ramp assembly as shown in other figures, such an assembly is also known as a "docking station". The 620 catch pan removably attaches to at least one baserail and deck wash doorway exterior plate using at least one interference fit detail and mating detail. For example, a peg and mating hole. The handle and shaft are used to remove the catch pan, and then return it to at least one baserail attachment point. The catch pan is designed for use with a broom, hose or pressure washer and can have a perforated rear doorway to capture debris while allowing water to flow through. When the catch pan is secured to the wall at the opening, the pressure washer, hose, or other forcing means will blow the debris to the outside of the enclosure through the doorway. The direction of flow is demonstrated with the "out" arrow in the figure.

I claim:

1. A doorway device including an assembly of components located between an inside space and an outside space of an enclosed area, the enclosed area including a plurality of walls; the assembly of components is located at a bottom of a wall of the plurality of walls, the wall including wall screening, wherein the assembly of components is installed over a baserail of the wall; the assembly of components is configured to replace a removed section of the wall screening; the assembly of components includes a base with a ramp and vertical sides along the ramp to channel a flow of water and debris from inside the enclosure, up and over the baserail, and out through a one-way door; the assembly of components includes an internal and external clamping structure that attaches to both the base rail and the wall screening, thereby providing an opening in the assembly of components between the inside space and the outside space.

2. The doorway device of claim 1, wherein the assembly of components is attached at lateral ends to sections of the baserail; the assembly of components is configured to replace a corresponding open section of the baserail and screening.

3. The doorway device of claim 1, wherein the assembly of components further includes a doorway comprising a rotating blade mechanism.

4. The doorway device of claim 1, wherein the assembly of components is configured to have flexible vanes secured internally along a top edge and freely moving at a lower edge as a one-way flow control of water and debris through the device.

5. The doorway device of claim 1, wherein the assembly of components also includes a removable catch pan and handle.

6. The doorway device of claim 1, wherein the assembly of components includes channels to receive loose screen edges and spline to secure the loose screen edges.

* * * * *